US005826514A

United States Patent [19]

Romero Salvo

[11] Patent Number: 5,826,514

[45] Date of Patent: Oct. 27, 1998

[54] INTRODUCED IN WETTING SYSTEMS FOR OFFSET PRINTING AND A MECHANISM FOR THEIR APPLICATION

[75] Inventor: Gerardo Antonio Romero Salvo, Zarsgaza, Spain

[73] Assignee: Technicas Especiales de Oxigenacion, S.L., Barcelona, Spain

[21] Appl. No.: 727,243

[22] Filed: Oct. 8, 1996

[30] Foreign Application Priority Data

Oct. 19, 1995 [ES] Spain ..... 9502031

[51] Int. Cl.[6] ..... B41M 1/00

[52] U.S. Cl. ..... 101/483; 101/147; 101/451

[58] Field of Search ..... 101/147, 148, 101/451, 483, 132.5; 106/2; 430/49

[56] References Cited

U.S. PATENT DOCUMENTS 5,181,467 1/1993 Takekoshi ..... 101/147

5,368,817 11/1994 Sudo et al. ..... 101/148

*Primary Examiner*—Ren Yan

*Attorney, Agent, or Firm*—Darby & Darby

[57] ABSTRACT

The improvements consist in supplying the wetting system with a water based solution including a determined additive. This solution is subjected, through a mechanism forming a part of this invention, to a process of agitation by which it adsorbs a high oxygen content. As a result of these improvements, the solution which wets the aluminium plate, from which the printing is done, acquires a high free oxygen content, increasing the water-ink interface and improving the quality of the printing.

5 Claims, 1 Drawing Sheet

INTRODUCED IN WETTING SYSTEMS FOR OFFSET PRINTING AND A MECHANISM FOR THEIR APPLICATION

DESCRIPTION

AIM OF THE INVENTION

The present invention, as indicated in the title, refers to certain improvements aimed at eliminating the isopropyl alcohol, or isopropanol, contained in the solutions used in offset printing wetting systems, thus improving the printing specifications, and also includes a mechanism which will allow for the application of the said improvements.

BACKGROUND OF THE INVENTION

The process of offset printing is based on certain physicochemical surface phenomena. The stage which precedes the application of the ink to the paper consists of phenomena of attraction and repulsion between the wetting solution and the ink, this allows for the formation of an image on an aluminium plate which is then directly transferred to a rubber blanket cylinder, and from there to the paper. In order to obtain satisfactory results it is necessary that both the ink and the solution, which is supplied to the wetting system of the machine, possess certain determined physicochemical features.

The most widely used wetting solution consists of water, with certain additives providing the system with determined features, and one part, between 8 and 10%, of isopropyl alcohol.

The use of isopropyl alcohol in the wetting solution ensures an interfacial tension between the water and the ink which allows for the achievement of a lesser degree of emulsification of the water in the ink, as a result of which the ink printed onto the paper benefits from a higher level of saturation than can be achieved with any other wetting system.

The isopropyl alcohol, or isopropanol, provides the solution with other advantages, such as a greater viscosity allowing for a more uniform transference, a greater drying speed, and a lowering of the surface tension which ensures that the film of the solution on the plate is very thin, and that it has a lesser tendency to mechanical emulsification.

Independently of the advantages which the addition of isopropyl alcohol, to the solution used in the wetting system, brings to offset printing this product also presents certain important disadvantages, such as inflammability and toxicity, which make it dangerous, and which have given rise to a generalised tendency towards the elimination of this product, to the extent that its use is completely, or partially, prohibited in some countries.

The problem which is posed, therefore, is how to eliminate isopropyl alcohol from the solutions used for wetting and the formulation of additives, which has so far been attempted without success, that will allow for such an elimination while maintaining the water-ink interface, this being the principal problem.

The need to reduce the surface tension, in order to avoid mechanical emulsification up to levels of water-alcohol, obliges the use of group III surface-active agents, however a greater concentration of these surface-active agents leads to a decrease of the interface, due to the affinity between the fatty acids of the ink and the hydrocarbon chains of these substances; this, together with the current impossibility of forming stable colloids which reduce the surface tension and maintain a greater interface, is the reason why alcohol cannot be eliminated from the wetting systems.

DESCRIPTION OF THE INVENTION

The improvements, which are the object of the invention, consist in supplying the wetting system with a solution of water containing a concentrated additive in which layers of vapour have previously been formed on the surface of the solution itself, with the aim of ensuring that the whole of the film of the solution applied to the corresponding printing plate acquires a high free oxygen content.

The formation of the layers of vapour on the surface of the solution, is achieved by subjecting the solution to a process of free oxygen absorbtion. The adsorption process is achieved by subjecting the solution to a process of high speed agitation, by spraying jets of the solution at a small volume of the solution itself, this small volume being that which, in a continuous manner, supplies the wetting system.

The components which make up the additive are as follows: propanotriol, sodium citrate. glacial acetic acid, citric acid, sodium benzoate, 1-ascorbic acid and sodium metaphosphate.

The purpose of the additive consists in creating conditions in which, during the above mentioned agitation, a high level of oxygen emulsification is produced on the solution and, at the same time, that this oxygen disappears at a determined speed from the body of the solution.

The effecting of the supply of the wetting system with the above mentioned solution, previously subjected to the process of adsorption of oxygen, will ensure certain values of surface tension, interface tension and viscosity which provide a series of very important advantages with regard to the offset printing conditions obtained with conventional wetting systems. The most important advantages being:

- The complete elimination of isopropyl alcohol.
- A greater uniformity of the spreading of the ink on the plate.
- Obtaining a thinner and more homogeneous film of solution on the plate.
- A lower level of emulsification of the solution with the ink.
- A reduction of ink consumption, between 10 and 14%.
- More brilliant colours.
- A greater ink drying speed.
- The possibility of increasing printing speed.
- Better wet on wet printing in multi-colour machines.
- A better printing contrast.
- Better printing with special screens, for example stochastics screens.
- The reduction or elimination of the use of anti-offset powders.

In order to obtain a significant adsorption of oxygen by the wetting solution, the invention contemplates the use of a mechanism which includes a main tank for the solution, an outlet line from the same fitted with a pump which propels the solution towards a spray which then sprays it in a jet against the walls of a reservoir, the agitation thus causing the adsorption of a high content of oxygen by the solution, a feed line, which connects the reservoir to the wetting system of the printing machine and a line through which the solution returns to the mechanism's main tank.

DESCRIPTION OF THE DRAWINGS

As a complement to this description, and in order to assist in a better understanding of the features of the invention, this present patent specification is accompanied, as an integral part of the same, by a set of drawings, as an illustration but that are not in any case limiting, which represent the following.

PREFERABLE EMBODIMENT OF THE INVENTION

Figure 1:
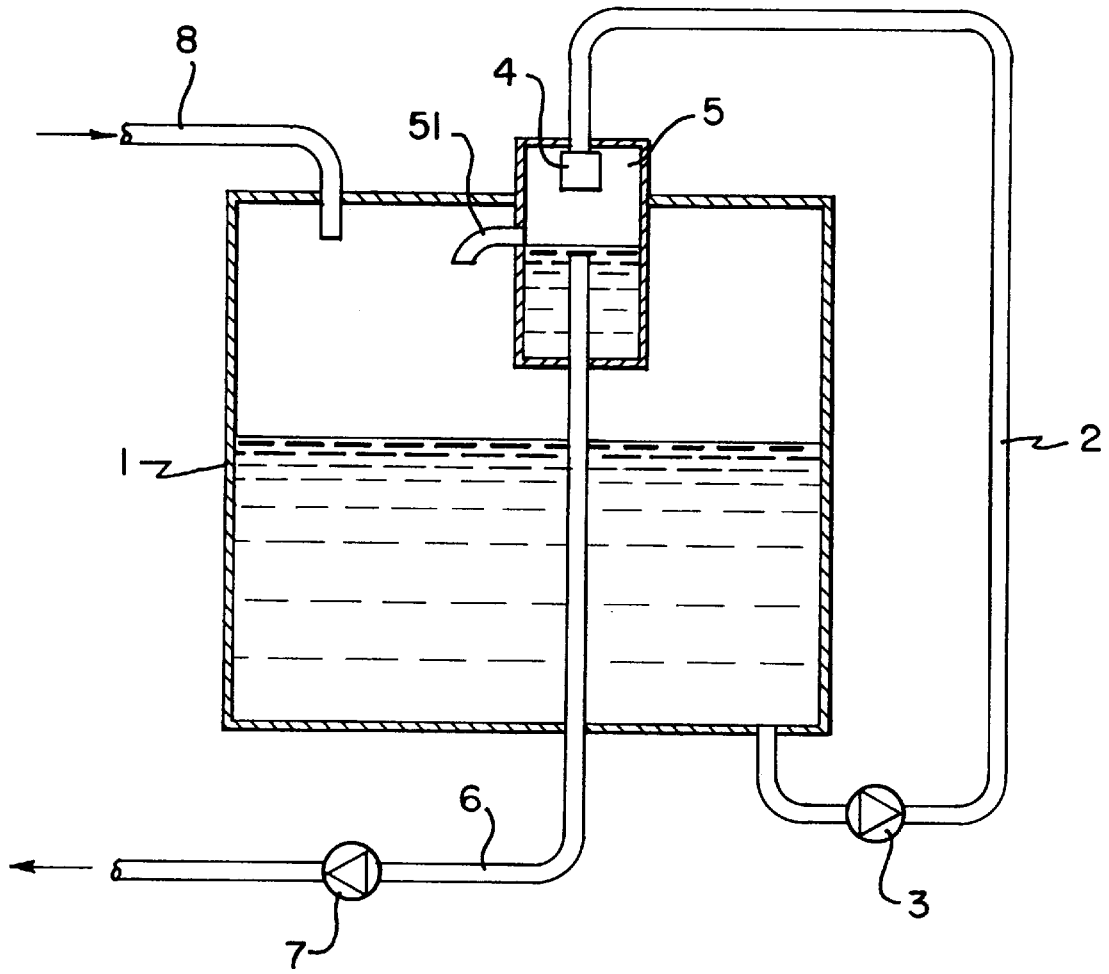
FIG. 1 shows a schematic view of the mechanism employed to produce a significant agitation of the wetting solution, which ensures a high level of oxygen adsorption by the solution.

The preferable embodiment requires that the solution used to supply the wetting system shall consist of water and an additive, the quantity of additive to be used being between 3 and 5%.

The components, and the amounts of the components to be used to make up the additive, will preferably be as follows, from 300 to 600 ml. of propanotriol, from 20 to 50 gr. of sodium citrate, from 8 to 24 ml. of glacial acetic acid, between 0.5 and 2 gr. of 1-ascorbic acid and 0.1 to 1 gr. of sodium metaphosphate.

The invention also contemplates the use of a mechanism aimed at causing the solution to adsorb oxygen, before being supplied to the wetting system of the offset printing machine. This mechanism, the description of which is presented here only as an example, and in no way as a limitation, includes a main tank (1), which contains the solution; an outlet line (2), which includes a pump (3), to propel the solution towards a spray (4), which in turns sprays it against the walls of a reservoir (5); a feed line (6), fitted with a pump (7), which propels the solution from the reservoir (5) to the wetting system of the offset printing machine; and a line (8) through which the solution returns from the wetting system of the machine to the main tank (1).

The shock caused by the jet of the solution, sprayed by the spray (4) against the walls of the reservoir (5), leads to the process of adsorption of oxygen by the solution.

The receptacle (5) has a side overflow (51), through which the surplus solution pours out into the tank (1).

The mouth of the feed line (7) is located just under the surface of the solution contained in the receptacle (5), in order to effect the supply to the wetting system with the surface part of the solution containing the highest content of free oxygen.

It is not considered that it is necessary to further extend this description, insofar as any expert in this material will be able to understand the invention, and the advantages which derive therefrom.

The terms in which this patent specification has been drawn up must in all cases be taken in the widest possible sense, and never as a limitation.

The materials, form, size and disposition of the elements will be susceptible to variation, always insofar as this does not mean an alteration of the essential specifications of the invention, which are claimed in continuation.

I claim:

1. A method for wetting an offset printing plate with an aqueous solution which has a high free oxygen content, which comprises:

preparing an aqueous solution by admixing water and an additive, said additive comprising propanotriol, sodium citrate, glacial acetic acid, 1-ascorbic acid, and sodium metaphosphate;

adsorbing oxygen to said aqueous solution to provide said aqueous solution with a high content of free oxygen, wherein layers of vapor are formed on the surface said aqueous solution;

providing a printing plate; and wetting said printing plate with said free oxygen-containing aqueous solution.

2. The method of claim 1, wherein said additive comprises between 3 and 5 percent of said aqueous solution.

3. The method of claim 2 wherein said additive is a mixture of from 300 to 600 ml of propanotriol, from 20 to 50 grams of sodium citrate, from 8 to 24 milliliters of glacial acetic acid, from 0.5 to 2 grams of 1-ascorbic acid, and from 0.1 to 1 tram of sodium metaphosphate.

4. The method of claim 1, wherein said absorbing stop comprises agitating said aqueous solution.

5. The method of claim 4, wherein said agitating comprises continuously spraying said aqueous solution onto a reduced volume of said aqueous solution.

* * * * *